US012747575B2

(12) United States Patent
Ramarathnam et al.

(10) Patent No.: US 12,747,575 B2
(45) Date of Patent: Sep. 29, 2026

(54) VARIABLE ORTHOGRID STIFFENED SHELL

(71) Applicant: Chairman, Defence Research and Development Org, New Delhi (IN)

(72) Inventors: Santhosh Ramarathnam, Hyderabad (IN); Sainath Yadav Kanyaboina, Hyderabad (IN); Ismail Shaik, Hyderabad (IN); Prasad Goud Alasani, Hyderabad (IN); Prakash Chand Jain, Hyderabad (IN); Anil Prasad Dash, Hyderabad (IN); Gurunath Prabushetty Biradar, Hyderabad (IN)

(73) Assignee: Chairman, Defence Research and Development Organization, Ministry of Defence, Govt. of India, New Delhi (IN)

( * ) Notice: Subject to any disclaimer, the term of this patent is extended or adjusted under 35 U.S.C. 154(b) by 216 days.

(21) Appl. No.: 18/840,682

(22) PCT Filed: Feb. 22, 2023

(86) PCT No.: PCT/IB2023/051628

§ 371 (c)(1),
(2) Date: Aug. 22, 2024

(87) PCT Pub. No.: WO2023/161822

PCT Pub. Date: Aug. 31, 2023

(65) Prior Publication Data

US 2025/0171996 A1 May 29, 2025

(30) Foreign Application Priority Data

Feb. 24, 2022 (IN) ..... 202211010003

(51) Int. Cl.
*E04B 1/19* (2006.01)

(52) U.S. Cl.
CPC ..... *E04B 1/19* (2013.01); *E04B 2001/1981* (2013.01)

(58) Field of Classification Search
CPC .. E04B 1/19; E04B 2001/1981; E04C 2/3405; E04C 2002/3472; E04C 2/326;
(Continued)

(56) References Cited

U.S. PATENT DOCUMENTS 1,356,000 A * 10/1920 Nelson ..... E06B 3/7001 52/630
1,427,120 A * 8/1922 Nelson ..... B61D 19/005 52/630
(Continued)

OTHER PUBLICATIONS

International Search Report issued in copending Indian Patent Application No. PCT/IB2023/051628 on Jul. 10, 2023.

*Primary Examiner* — Medhat Badawi
(74) *Attorney, Agent, or Firm* — Whiteford, Taylor & Preston, LLP; Peter J. Davis

(57) ABSTRACT

The present disclosure relates to orthogrid stiffened structures. The present disclosure envisages a variable orthogrid stiffened shell (100). The shell (100) comprises at least one face sheet (102), a plurality of stringers (104) and a plurality of rings (106) attached to the face sheet (102). The stringers (104) are attached parallel to each other. The rings (106) are attached to the face sheet (102) across the stringers (104) to form an orthogrid array (110) on the face sheet (102). The dimensions of thickness and height of the stringers (104) vary from the dimensions of thickness and height of the rings (106).

16 Claims, 1 Drawing Sheet

(58) Field of Classification Search
CPC ..... E04C 2/20; B29D 99/0017; B64C 1/1407; Y10T 428/12444
See application file for complete search history.

(56) References Cited

U.S. PATENT DOCUMENTS

| | | | | |
|---|---|---|---|---|
| 2,869,228 | A * | 1/1959 | Martin | B65D 19/0075 29/445 |
| 3,133,616 | A * | 5/1964 | Haskins | E04C 2/384 D25/19 |
| 3,587,914 | A * | 6/1971 | Jennings | B64D 37/06 220/900 |
| 4,012,549 | A * | 3/1977 | Slysh | E04C 2/38 52/630 |
| 4,725,334 | A * | 2/1988 | Brimm | C23F 1/04 216/34 |
| 6,190,484 | B1 * | 2/2001 | Appa | B29C 70/32 156/169 |
| 6,877,286 | B2 * | 4/2005 | Johnson | E06B 3/28 52/204.593 |
| 7,159,822 | B2 * | 1/2007 | Grantham | B64C 3/182 244/119 |
| 7,475,850 | B2 * | 1/2009 | Vetillard | B64C 1/18 244/119 |
| 8,042,315 | B2 * | 10/2011 | Ashton | E04C 2/326 244/119 |
| 8,517,309 | B2 * | 8/2013 | Robinson | B64C 1/1407 52/630 |
| 8,540,921 | B2 * | 9/2013 | Senibi | B32B 9/007 264/316 |
| 9,919,791 | B2 * | 3/2018 | Autry | B64C 3/18 |
| 9,978,354 | B2 * | 5/2018 | Nampy | G10K 11/168 |
| 10,150,553 | B2 * | 12/2018 | Cacciaguerra | B64C 1/069 |
| 10,850,826 | B2 * | 12/2020 | Chengalva | B64C 3/22 |
| 11,175,117 | B2 * | 11/2021 | Bavanari | F42B 10/14 |
| 11,242,822 | B2 * | 2/2022 | Gurvich | F02C 7/24 |
| 11,518,493 | B2 * | 12/2022 | Wang | B64C 1/40 |
| 11,577,815 | B2 * | 2/2023 | Heeringa | B64C 1/061 |
| 11,643,183 | B2 * | 5/2023 | Bhatia | B64C 3/187 244/123.7 |
| 11,772,775 | B2 * | 10/2023 | Linton | B64C 3/20 244/123.1 |
| 12,116,781 | B1 * | 10/2024 | Yin | E04C 3/08 |
| 12,134,458 | B2 * | 11/2024 | Heeringa | B64F 5/10 |
| 12,195,180 | B2 * | 1/2025 | Suzuki | F16B 5/04 |
| 12,286,784 | B1 * | 4/2025 | Rennard | E04B 1/19 |
| 2004/0035979 | A1 * | 2/2004 | McCoskey, Jr. | B64C 1/12 244/117 R |
| 2004/0055349 | A1 * | 3/2004 | El-Soudani | B64C 1/12 72/56 |
| 2007/0227094 | A1 * | 10/2007 | Oscar | B65D 90/027 52/630 |
| 2008/0290214 | A1 * | 11/2008 | Guzman | B64C 3/182 244/119 |
| 2009/0320398 | A1 * | 12/2009 | Gouvea | B29C 66/474 52/309.1 |
| 2010/0133380 | A1 * | 6/2010 | Roebroeks | B32B 15/08 244/119 |
| 2014/0186586 | A1 * | 7/2014 | Victorazzo | B64C 1/12 428/167 |
| 2016/0355273 | A1 * | 12/2016 | Perez Diaz | B64C 3/34 |
| 2019/0154420 | A1 * | 5/2019 | Bavanari | F42B 10/14 |
| 2022/0042295 | A1 * | 2/2022 | Bertoldi | E04C 5/06 |
| 2023/0024343 | A1 * | 1/2023 | Miles | E04C 3/005 |
| 2023/0265645 | A1 * | 8/2023 | Scrafford | E04B 1/19 52/633 |
| 2024/0229445 | A1 * | 7/2024 | Wang | E04B 1/32 |
| 2024/0301676 | A1 * | 9/2024 | Kajikawa | E04B 1/1903 |
| 2024/0384522 | A1 * | 11/2024 | Van Egmond | E04B 1/19 |
| 2025/0003206 | A1 * | 1/2025 | Ward | E04B 1/19 |
| 2025/0122714 | A1 * | 4/2025 | Rafezy | E04B 1/2403 |
| 2025/0171996 | A1 * | 5/2025 | Ramarathnam | E04B 1/19 |

* cited by examiner

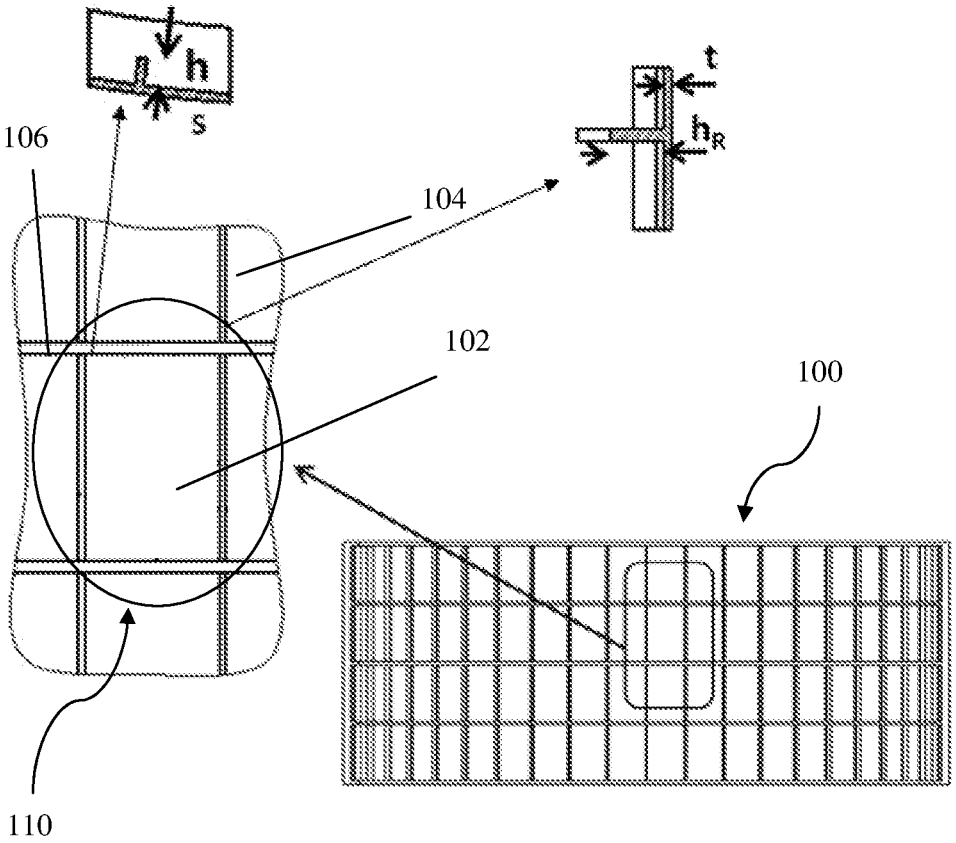
h
s
t
$h_R$
106
104
102
100
110

VARIABLE ORTHOGRID STIFFENED SHELL

FIELD

The present disclosure relates to orthogrid stiffened structures.

Definition

As used in the present disclosure, the following terms are generally intended to have the meaning as set forth below, except to the extent that the context in which they are used indicate otherwise.

Orthogrid is a partially hollowed-out structure made from a single sheet having orthogonal stiffening ribs provided thereon.

BACKGROUND

The background information herein below relates to the present disclosure but is not necessarily prior art.

Orthogrid structures are typically used in high-performance applications such as submerged shell structures, missiles, and launch vehicles, which are required to withstand huge amounts of forces exerted thereon. It is necessary that the conventional orthogrid structures are manufactured from materials having a high strength-to-weight ratio to overcome the drawbacks of the external forces exerted thereon. Further, it is required that the structure has a high stiffness factor. To satisfy both these objections, it is desired that the structure has relatively thinner skin. However, reduction in the skin thickness makes the conventional structures prone to buckling loads, thereby curtailing the use of orthogrid structures especially in semi-monocoque constructions.

There is therefore felt a need for an orthogrid structure that alleviates the aforementioned drawback.

OBJECTS

Some of the objects of the present disclosure, which at least one embodiment herein satisfies, are as follows:

An object of the present disclosure is to provide an orthogrid structure.

Another object of the present disclosure is to provide an orthogrid structure which has relatively reduced mass.

Yet another object of the present disclosure is to provide an orthogrid structure which has a relatively high stiffness factor.

Other objects and advantages of the present disclosure will be more apparent from the following description, which is not intended to limit the scope of the present disclosure.

SUMMARY

The present disclosure envisages a variable orthogrid stiffened shell. The orthogrid stiffened shell comprises at least one face sheet, a plurality of stringers, and a plurality of rings attached to the face sheet. The stringers are attached to the face sheet parallel to each other. The rings are attached to the face sheet across the stringers to form an orthogrid array on the face sheet. The dimensions of thickness and height of the stringers vary from the dimensions of thickness and height of the rings.

In an embodiment, the sheet is defined by an operative inner face sheet and an operative outer face sheet.

In an embodiment, each of the plurality of stringers and the plurality of rings are tensioned along the outer face sheet. Each of the plurality of stringers are aligned parallel to each other and extend operative longitudinally along the outer face sheet.

In an embodiment, each of the plurality of rings are aligned parallel to each other and extend operative circumferentially along the outer face sheet of the shell. The distance between the two rings is different than the distance between the two stringers.

Further, the dimensions of thickness (t) and height ($h_S$) of each of the stringers are different from the dimensions of thickness (t) and height ($h_R$) of each of the rings.

In an embodiment, the cross-section of each of the plurality of rings is different than the cross-section of each of the plurality of stringers.

In an embodiment, the ratio of thickness of the shell to the thickness of the ring varies between 0.4 and 2.

In yet another embodiment, the ratio of the height of the ring to the thickness of the shell varies between 5 and 17.

In one embodiment, the stringers are welded to the face sheet.

In another embodiment, the stringers are adhered to the face sheet.

In yet another embodiment, the rings are welded to the face sheet.

In still another embodiment, the rings are adhered to the face sheet.

In another embodiment, the stringers and the rings are manufactured integrally.

In an embodiment, the face sheet is of a material selected from the group consisting of steel, aluminium, titanium and composites.

BRIEF DESCRIPTION OF THE ACCOMPANYING DRAWING

A variable orthogrid stiffened shell of the present disclosure will now be described with the help of the accompanying drawing, in which:

FIG. 1 illustrates a front view of the orthogrid stiffened shell of the present disclosure.

LIST OF REFERENCE NUMERALS

100 orthogrid stiffened shell
102 face sheet
104 stringer
106 ring
110 orthogrid
t thickness of skin
$h_R$ height of ring
$h_S$ height of stringer
$t_R$ thickness of ring
$t_S$ thickness of stringer

DETAILED DESCRIPTION

Embodiments, of the present disclosure, will now be described with reference to the accompanying drawing.

Embodiments are provided so as to thoroughly and fully convey the scope of the present disclosure to the person skilled in the art. Numerous details are set forth, relating to specific components, and methods, to provide a complete understanding of embodiments of the present disclosure. It will be apparent to the person skilled in the art that the details provided in the embodiments should not be construed to limit the scope of the present disclosure. In some embodiments, well-known processes, well-known apparatus structures, and well-known techniques are not described in detail.

The terminology used, in the present disclosure, is only for the purpose of explaining a particular embodiment and such terminology shall not be considered to limit the scope of the present disclosure. As used in the present disclosure, the forms "a," "an," and "the" may be intended to include the plural forms as well, unless the context clearly suggests otherwise. The terms "comprises," "comprising," "including," and "having," are open ended transitional phrases and therefore specify the presence of stated features, operations, elements, modules, units and/or components, but do not forbid the presence or addition of one or more other features, operations, elements, components, and/or groups thereof.

When an element is referred to as being "mounted on," "engaged to," "connected to," or "coupled to" another element, it may be directly on, engaged, connected or coupled to the other element. As used herein, the term "and/or" includes any and all combinations of one or more of the associated listed elements.

The terms first, second, third, etc., should not be construed to limit the scope of the present disclosure as the aforementioned terms may be only used to distinguish one element, component, region, layer or section from another component, region, layer or section. Terms such as first, second, third etc., when used herein do not imply a specific sequence or order unless clearly suggested by the present disclosure.

Terms such as "inner," "outer," "beneath," "below," "lower," "above," "upper," and the like, may be used in the present disclosure to describe relationships between different elements as depicted from the FIGURES.

A variable orthogrid stiffened shell (100) of the present disclosure will now be described with reference to FIG. 1.

The orthogrid stiffened shell (100) comprises at least one face sheet (102). The face sheet is defined an operative outer face sheet and an operative inner face sheet. The shell (100) further comprises a plurality of stringers (104) and a plurality of rings (106). Each of the stringers (104) and the rings (106) are attached to the operative outer face sheet (102). The stringers (104) are attached to the face sheet (102) parallel to each other. The rings (106) are attached to the outer face sheet (102) across the stringers (104) to form an orthogrid array (110) on the outer face sheet (102). Each of the stringers (104) and the rings (106) are tensioned along the outer face sheet (102) The stringers (104) extend operative longitudinally along the outer face sheet, whereas the rings (106) extend operative circumferentially along the outer face sheet of the shell (100).

The dimensions of thickness (t) and height ($h_S$) of the stringers (104) vary from the dimensions of thickness (t) and height ($h_R$) of the rings (106).

In an embodiment, the distance between the two rings (106) is different than the distance between the two stringers (104). The cross-section of each of the plurality of rings (106) is different than the cross-section of each of the plurality of stringers (104).

Due to the difference in the dimensions of the thickness and height ($h_S$, $h_R$, $t_R$, $t_S$) of the stringers (104) and rings (106), the orthogrid stiffened shell (100), of the present disclosure, has its mass reduced by approximately 6-17%. Further, the variation in the thickness and height of the stringers (104) and the rings (106) allows equal distribution of pressure, forces, or bending moment exerted thereon. Additionally, the stiffness factor of the shell (100) increases to prevent buckling of the shell (100) caused by the pressure, forces, bending moment, or even a combination of all. The relatively reduced mass further facilitates an increase in the payload carrying capacity of the vehicle, which is highly appreciated in applications such as missile airframe structures, launch vehicles, and submerged shell structures.

In an embodiment, the ratio of the thickness of the shell (100) to the thickness of the ring (106) varies between 0.4 and 2.

In an embodiment, the ratio of the height of the ring (106) to the thickness of the shell (100) varies between 5 and 17.

In an embodiment, the stringers (104) and the rings (106) are welded to the face sheet (102). In another embodiment, the stringers (104) and the rings (106) are adhered to the face sheet (102).

In one embodiment, the face sheet (102) is of a material having a high strength-to-weight ratio. In another embodiment, the face sheet (102) is of a material selected from the group consisting of steel, aluminium, titanium and composites. In another embodiment, the stringers (104) and the rings (106) are manufactured integrally.

In an exemplary embodiment, Table 1 represents the ratio of mass of variable orthogrid to mass of conventional orthogrid with respect to slenderness ratio and R/t ratio for different shapes.

TABLE 1

| Shape | Slenderness ratio | R/t | Ratio of mass of orthogrid shell, of present disclosure, to mass of conventional orthogrid |
|---|---|---|---|
| Cylinder | 0.379 | 208 | 0.83 |
| Cone | 0.259 | 206 | 0.94 |
| Cylinder | 0.375 | 200 | 0.84 |
| Cylinder | 0.333 | 200 | 0.94 |
| Cylinder | 0.267 | 200 | 0.92 |

From Table 1, it can be concluded that the orthogrid shell (100), of present disclosure exhibits relatively decreased mass for the same slenderness ratio and R/t ratio for a particular shape as compared to a conventional orthogrid.

The foregoing description of the embodiments has been provided for purposes of illustration and not intended to limit the scope of the present disclosure. Individual components of a particular embodiment are generally not limited to that particular embodiment, but, are interchangeable. Such variations are not to be regarded as a departure from the present disclosure, and all such modifications are considered to be within the scope of the present disclosure.

TECHNICAL ADVANCEMENTS

The present disclosure described hereinabove has several technical advantages including, but not limited to, the realization of a variable orthogrid stiffened shell, which:

has relatively reduced mass; and has a relatively high stiffness factor.

The foregoing disclosure has been described with reference to the accompanying embodiments which do not limit the scope and ambit of the disclosure. The description provided is purely by way of example and illustration.

The embodiments herein and the various features and advantageous details thereof are explained with reference to the non-limiting embodiments in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

The foregoing description of the specific embodiments so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the embodiments as described herein.

Any discussion of materials, devices, articles or the like that has been included in this specification is solely for the purpose of providing a context for the disclosure. It is not to be taken as an admission that any or all of these matters form a part of the prior art base or were common general knowledge in the field relevant to the disclosure as it existed anywhere before the priority date of this application.

While considerable emphasis has been placed herein on the components and component parts of the preferred embodiments, it will be appreciated that many embodiments can be made and that many changes can be made in the preferred embodiments without departing from the principles of the disclosure. These and other changes in the preferred embodiment as well as other embodiments of the disclosure will be apparent to those skilled in the art from the disclosure herein, whereby it is to be distinctly understood that the foregoing descriptive matter is to be interpreted merely as illustrative of the disclosure and not as a limitation.

The invention claimed is:

1. A variable orthogrid stiffened shell comprising:

at least one face sheet;

a plurality of stringers attached to said face sheet; and a plurality of rings attached to said face sheet across said stringers to form an orthogrid array on said face sheet.

2. The orthogrid stiffened shell as claimed in claim 1, wherein said face sheet is defined by an operative inner face sheet and an operative outer face sheet.

3. The orthogrid stiffened shell as claimed in claim 2, wherein each of said plurality of stringers and said plurality of rings are tensioned along said outer face sheet.

4. The orthogrid stiffened shell as claimed in claim 2, wherein each of said plurality of stringers are aligned parallel to each other and extend operative longitudinally along said outer face sheet.

5. The orthogrid stiffened shell as claimed in claim 2, wherein each of said plurality of rings are aligned parallel to each other and extend operative circumferentially along said outer face sheet of said shell.

6. The orthogrid stiffened shell as claimed in claim 1, wherein the distance between said two rings is different than the distance between said two stringers.

7. The orthogrid stiffened shell as claimed in claim 1, wherein the dimensions of thickness (t) and height ($h_S$) of each of said stringers are different from the dimensions of thickness (t) and height ($h_R$) of each of said rings.

8. The orthogrid stiffened shell as claimed in claim 7, wherein the cross-section of each of said plurality of rings is different than the cross-section of each of said plurality of stringers.

9. The orthogrid stiffened shell as claimed in claim 7, wherein the ratio of the thickness of said shell to the thickness of said ring varies between 0.4 and 2.

10. The orthogrid stiffened shell as claimed in claim 7, wherein the ratio of the height of said ring to the thickness of said shell varies between 5 and 17.

11. The orthogrid stiffened shell as claimed in claim 1, wherein said stringers are welded to said face sheet.

12. The orthogrid stiffened shell as claimed in claim 1, wherein said stringers are adhered to said face sheet.

13. The orthogrid stiffened shell as claimed in claim 1, wherein said rings are welded to said face sheet.

14. The orthogrid stiffened shell as claimed in claim 1, wherein said rings are adhered to said face sheet.

15. The orthogrid stiffened shell as claimed in claim 1, wherein said stringers and said rings are manufactured integrally.

16. The orthogrid stiffened shell as claimed in claim 1, wherein said face sheet is of a material selected from the group consisting of steel, aluminum, titanium and composites.

* * * * *